US006926307B2

(12) United States Patent
Mathews-Lingen

(10) Patent No.: US 6,926,307 B2
(45) Date of Patent: Aug. 9, 2005

(54) PHOTO JOURNAL SCRAPBOOK

(76) Inventor: Robyn L. Mathews-Lingen, 2126 Jefferson Ave., St. Paul, MN (US) 55105

( * ) Notice: Subject to any disclaimer, the term of this patent is extended or adjusted under 35 U.S.C. 154(b) by 0 days.

(21) Appl. No.: 10/335,465

(22) Filed: Dec. 31, 2002

(65) Prior Publication Data

US 2003/0122365 A1 Jul. 3, 2003

Related U.S. Application Data

(60) Provisional application No. 60/345,213, filed on Jan. 2, 2002.

(51) Int. Cl.[7] ..... B42D 1/08

(52) U.S. Cl. ..... 281/22; 40/299.01; 281/15.1; 281/38; 283/63.1; 434/317

(58) Field of Search ..... 40/299.01, 530, 40/584; 434/317, 428; 283/61, 62, 63.1, 64; 281/15.1, 22, 29, 36, 37, 38, 51

(56) References Cited

U.S. PATENT DOCUMENTS

| | | | | | |
|---|---|---|---|---|---|
| 1,719,648 | A | * | 7/1929 | Browne | 206/321 |
| 3,565,462 | A | | 2/1971 | Gottlieb | 281/3 |
| 4,965,948 | A | | 10/1990 | Ruebens | 40/537 |
| 5,082,312 | A | * | 1/1992 | Arrowood | 283/67 |
| 5,437,514 | A | | 8/1995 | Minch | 402/79 |
| 5,490,739 | A | | 2/1996 | Olson | 402/79 |
| 5,509,746 | A | | 4/1996 | Ho | 402/79 |
| 5,634,667 | A | | 6/1997 | Jordan | 281/29 |
| 5,816,730 | A | | 10/1998 | Alspaw et al. | 402/79 |
| 5,947,522 | A | * | 9/1999 | Boehm | 281/22 |
| D421,049 | S | * | 2/2000 | Candelaria et al. | D19/26 |
| 6,171,008 | B1 | * | 1/2001 | Ochsner | 402/79 |
| 6,210,172 | B1 | * | 4/2001 | Clements | 434/428 |
| 6,267,413 | B1 | | 7/2001 | Tran | 281/29 |
| 6,322,272 | B1 | | 11/2001 | Solis | 402/79 |
| 6,474,010 | B1 | | 11/2002 | Hwang | 40/776 |
| 2003/0079386 | A1 | * | 5/2003 | Noble | 40/453 |

* cited by examiner

*Primary Examiner*—Monica S. Carter
(74) *Attorney, Agent, or Firm*—Fredrikson & Byron, PA

(57) ABSTRACT

The present invention relates to a photo journal scrapbook which combines the attributes of a photo album, a scrapbook, and a journal in a single book. The book has a number of pages, a front and back cover, and a binder to hold the binder and pages together. The book may also include pocket pages to include larger items, and can be supplemented by the addition of pop-in pages by the user. Each page of the photo journal scrapbook has two different sides so that when the photo journal scrapbook is opened, frames for displaying photographs are present on one page, while lines with text prompts are present on the other page. This facilitates the inclusion of textual description alongside the included photographs. The photo journal scrapbook also utilizes variable size frames that can be altered to fit photographs of a variety of sizes.

20 Claims, 5 Drawing Sheets

PHOTO JOURNAL SCRAPBOOK

CROSS-REFERENCE TO RELATED APPLICATIONS

This application claims priority to Provisional Application Ser. No. 60/345,213, filed Jan. 2, 2002, the entire contents of which are incorporated by reference herein.

FIELD OF THE INVENTION

The present invention relates to photo journal scrapbooks in which photographs, articles, keepsakes and other memorabilia may be displayed in conjunction with notes written in prompt regions provided on journal pages. More particularly, the present invention relates to books which include the attributes of a photo album, journal, scrapbook, and keepsake storage item.

BACKGROUND OF THE INVENTION

Most individuals value certain memories above others, and given the frail nature of human memory, desire aids which can help them retain and supplement these particularly valued memories. One traditional means of doing this has been the use of photo albums, which provide a means of organizing and preserving photographs capturing various visual scenes.

The patent literature provides various examples of different types of keepsake and photo albums. For example, U.S. Pat. No. 4,965,948 to Ruebens discloses a photo album in which each page of the album is partially covered by a transparent sheet attached along several of its edges to the leaf page. Additional lines of attachment between the transparent sheet and the leaf page are oriented so as to permit horizontal or vertical storage of photographs, which can be stored on both sides of the leaf page.

Another example is found in U.S. Pat. No. 5,490,739 to Olson, which discloses a photo album comprising a plurality of pages in a binder, each of which serves as a photograph frame. Each page has a backing portion and a frame portion which contains an aperture for viewing an inserted photograph. Inserted photographs held in place by adhesive such as two-sided tape on the back of the frame section. Alignment lines may be used on the backing to help correctly position the photographs. Once the photograph is aligned and attached, the frame is closed over the backing section to create a frame page holding a photograph.

U.S. Pat. No. 5,634,667 to Jordan discloses a memorabilia album which is designed to retain a variety of objects, such as holograms, cards, fragrance samples, and fingerprints. The invention consists of a book-like album with a front cover which carries a picture which is attached by glue or Velcro. The memorabilia album consists of a long rectangular sheet folded into a plurality of portions. Different areas within the portions are designated for different items, such as a poem, fingerprints, and various stencils which the user can use to illustrate the interior of the album.

U.S. Pat. No. 5,816,730 to Alspaw discloses a personalized photograph collection book, in which the pages of the book are made to convey a self-contained message or theme through the use of pictorial representation. The book is conventional in structure, with a binder and cover portions. However, each page is made of three distinct components: a photograph portion configured to receive photographs and hold them in place, a pictorial portion spaced horizontally from the photograph portion, and a caption portion spaced vertically from the photograph portion. The book may also be provided with an instructional tear out page behind the front cover, describing how the book is typically used.

U.S. Pat. No. 6,267,413 to Tran discloses a photograph album which also serves as a standing frame for displaying selected photographs within the album. The album has an overall book-shaped design, with a binder, inserted pages, and a cover. The cover wraps inward to overlap selected pages within the album, with the overlapping cover portions providing a viewing window through with the covered photographs can be seen. The pages of the album can hold photographs through a variety of means, such as twin plies of thin polyethylene plastic. Fasteners are provided to lock the cover portions over the pages which hold photographs which the user would like to display. Thus, the album can be used both for storing photographs and as a freestanding structure to display selected pictures.

Finally, U.S. Pat. No. 6,322,272 to Solis discloses a photograph album with a novel means of attaching the photographs to the pages. The album consists of a cover, a binder, and interior pages, but is distinguished by the fact that a plurality of meltable segments are provided which can be positioned on the photograph pages. Photographs are positioned where desired over the meltable segments, and heat is applied to fix the photographs in place. The pages of the photo album consist of a rigid backing portion and a transparent cover portion.

These examples help illustrate the myriad of designs developed to meet the varied objectives and requirements of those desiring to store and display photographs and other memorabilia. However, while there has been substantial effort expended in the design of photograph albums, there exists a continuing need for a new and improved photograph album which combines allow an individual to display and organize photographs, articles, journal entries, keepsakes, and other memorabilia in an easy-to-use book. The present invention substantially fulfills this need.

SUMMARY OF THE INVENTION

The present invention relates to a photo journal scrapbook which includes the attributes of a photo album, a scrapbook, a journal, and a keepsake storage item in one, easy-to-use book, and does so in a way which accommodates holding the photographs in variable size frames. The book of the present invention has front and back covers, a plurality of pages between the outer cover, and a binder to hold the binder and pages together. Each page has two different sides so that when the photo journal scrapbook is opened, variable frames for displaying photographs are present on one page, while lined paper with text prompts are present on the other page.

In one embodiment of the present invention, the photo journal scrapbook is designed to archive yearly pictures from school programs, various team activities, and commercial studios. One advantage of the photo journal scrapbook is the way in which it includes the visual displays of a photo album, the flexibility of a scrapbook, and the intimacy of a journal into one, easy-to-use book. Unlike scrapbooks, a format is provided to capture pictures and memories, requiring no additional material or supplies. Having all of the needed components in one place minimizes the time required to fully document the desired activities. The availability of writing space and the presence of specific text prompts also serves to encourage the user to fill in the background information which helps supplement and reinforce the memory preserved by the photograph.

Another advantage of the photo journal scrapbook stems from the fact that the present invention is also designed to emphasize and hold odd-sized photographs through the use of variable size frames. Whereas a conventional photograph frame can only hold whatever single size of photograph it was designed for, the variable size frames of the present invention can be altered to display a variety of picture sizes. This flexibility is created by providing a set of concentric frames, from which the user can select one which most closely fits the photograph. The smallest sized frame is precut from the photograph page, and is surrounded by one or more increasingly larger potential frames. The outlines of these frames are marked and the material of the photograph page weakened at that point through perforation or other means. This allows the user to tear or cut the frame material at the selected frame size to quickly create an opening of the desired size.

The present invention thus comprises a photo journal scrapbook with front and back covers and a plurality of pages retained between the book covers, wherein one or more pages have a photograph frame side bearing one or more frames to retain photographs and a journal side with printing organized to receive writing. As a result of this page arrangement, the photo journal scrapbook displays both a photograph and journal side when opened to any page within the main page section. The photo journal scrapbook also included a binder which secures the front and back covers and the plurality of pages together. Preferably, the binding retains the front and back covers and pages in a fashion that enables their movement through an arc of at least 180° to allow opposing pages in said photo journal scrapbook to lie flat when the book is supported on a surface. In one embodiment, twin loop wire binding is utilized for binding the pages together. However, other binding techniques used in the art may be utilized to retain the pages of the book if desired. A library style soft hinge spine overwrap may be used to cover the binder and connect the front and back covers. The front and back covers are preferably made of hard cover material wrapped with soft chintz, sail cloth, or terra cotta canvas.

In one embodiment, the main pages of the photo journal scrapbook comprise sheets of paper folded in the center to form two equal portions which are overlaid and connected with an adhesive. The adhesive is preferably deposited in a pattern which reinforces the photograph frames. The photograph frame side of the page is preferably coated with a lower layer of ink, and an upper layer of varnish. The photo journal scrapbook preferably also includes one or more pocket pages retained by the binding for storing larger items.

The present invention also includes a method of making a photo journal scrapbook comprising a number of steps. The first step requires printing upon a plurality of book pages of a chosen size the desired backgrounds and markings to create photograph frame pages and journal pages on opposing sides of said book pages. Next, the book pages are cut and indented using a custom designed die to create the page shape, frame openings, score lines, and perforations. Adhesive is then administered to portions of one side of the book page, and the book page is folded in half at a center score line so that the page halves are bound together by said adhesive. The folded book pages are then collated and bound together along their inner edge. The bound, folded book pages are then inserted and attached into a wrapped cover.

The method of making a photo journal scrapbook preferably also includes the following additional steps. Preferably, a title page is collated into the front of the collated folded book pages, and a back page is collated into the back of the collated folded book pages, subsequent to collating the plurality of folded book pages. Additionally, a pocket page may be constructed and added to the photo journal scrapbook by scoring and folding a sheet of paper or cardboard to create a double sided pocket page and binding the one or more double sided pocket pages into the photo journal scrapbook. Preferably, twin loop wire is used to bind the collated folded book pages together. When twin loop wire binding is used, holes should be punched near one edge of the book pages to enable binding with the twin loop wire. An additional step, typically carried out by the book user, can be the manual attaching of supplementary pop-in scrapbook pages to the binding of the photo journal scrapbook.

The present invention also includes a method of using a photo journal scrapbook comprising the steps of opening a photo journal scrapbook, sliding in a photograph from the top of side of said photo journal scrapbook into a frame on a photograph frame page, and adding written commentary related to said photograph on the adjacent journal page. When a photo journal scrapbook includes variable size frames, and a picture for storage does not fit the precut frame opening, the method also includes altering the frame size, by sliding fingertips underneath the wallet opening of a variable size frame, gently pushing the frame outward until it breaks at the provided weakpoint adjacent to a glue point, and tearing away is the remainder of the undesired frame portion along the weakpoint lines. It is noted that the frame may alternately be sized by cutting the appropriate size opening at the indicated weakpoint. Additionally, the method of use may include the step of adding additional scrapbook pages, which may be permanently bound or inserted as pop-in pages.

Those skilled in the art will appreciate that the conception upon which this disclosure is based may readily be utilized as a basis for the design of other structures and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The above and other objects and aspects of the invention will be apparent from the description of embodiments illustrated by the following accompanying drawings.

DETAILED DESCRIPTION OF THE PREFERRED EMBODIMENTS

The present invention relates to photo journal scrapbooks designed to archive photographs and other material and information from particularly memorable events. The photo journal scrapbooks are generally high end, cloth-covered, acid-free, memory books, but other embodiments are also contemplated in the present invention. Certain embodiments are specifically designed to archive the commercial photos children receive from their schools and from various collegiate or recreational group activities in which they participate, as well as newspaper clippings and other items. The photo journal scrapbooks possess the simplicity of a photo album with the intimacy of a journal, and the flexibility of a scrapbook. The photo journal scrapbooks emphasize convenience and simplicity; from the cleanly lined journal pages with simple, gentle prompts, provided immediately adjacent to photograph framing pages using variable size BreakAway™ frames decorated with subtle embossing.

The photo journal scrapbooks are fully compatible with industry-standard archive quality scrapbook materials and pens, and contain the following components. While any type or color paper may be utilized in present invention, acid-free archive-quality pages in soft white are a preferred embodiment. The journal side of pages may include text prompts printed in soy-based black ink., while the photograph frame side of pages are preferably flood-coated in soy-based black ink. Other printing inks and materials may be employed if desired. Embossed, variable size BreakAway™ frames allow the user to slide in photos of varying size quickly and easily and without glue or tape. In the preferred embodiment, the pages are bound with book cloth wrapped covers and twin loop wire binding that lays flat when open. Preferably, the books also features pocket pages, which may be located at the back of the book or strategically placed throughout the book. The pockets are large enough to store up to fifteen 8"×10" photos in the Academic and Activities book embodiments, and up to eighteen 5"×7" photos in the Friends and Family Book embodiment.

Figure 1:
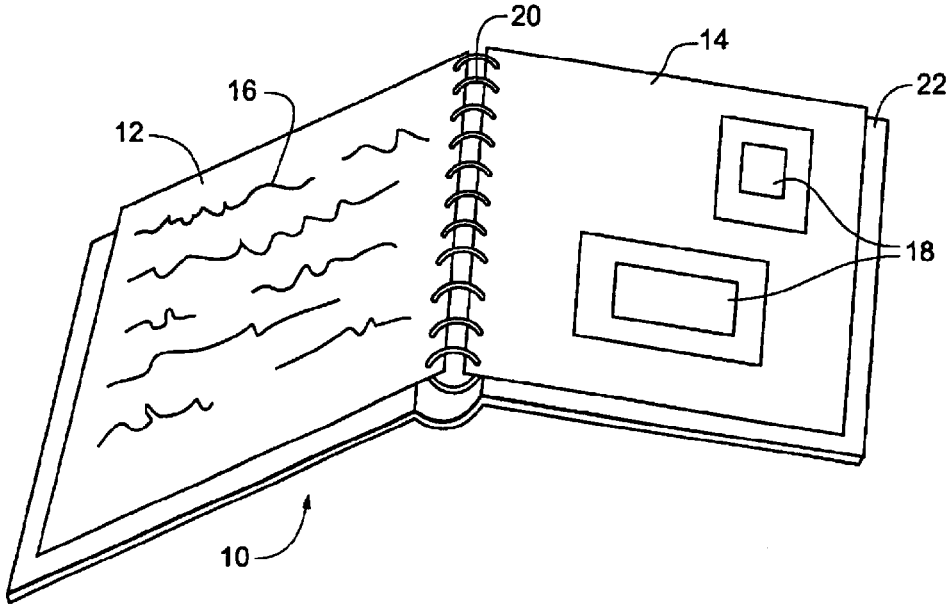
FIG. 1 is a perspective view of a photo journal scrapbook embodying the present invention.

A photo journal scrapbook in accordance with an embodiment of the present invention will now be described with reference to FIGS. 1 through 4. FIG. 1 shows a perspective view of a photo journal scrapbook 10 laid open as it would be for general use. As can be seen, when opened in this fashion the photo journal scrapbook 10 provides two different page surfaces, or sides; the journal side 12 and the photograph frame side 14. The journal side 12 contains prompts 16 consisting of text and lines which prompt the user by suggesting written entries and providing space where those entries can be recorded. Opposite the journal side is the photograph frame side 14 which enables the user to readily store photographs. One or more photograph frames 18 are present on each photograph frame side 14. Preferably, these frames are variable size photograph frames. Variable size photograph frames 18 are illustrated in greater detail in FIG. 3. The pages of the photo journal scrapbook are held together with a binder 20. The bound pages of the photo journal scrapbook are enclosed in a cover 22 which protects the pages of the photo journal scrapbook and provides an aesthetically appealing exterior.

Figure 2:
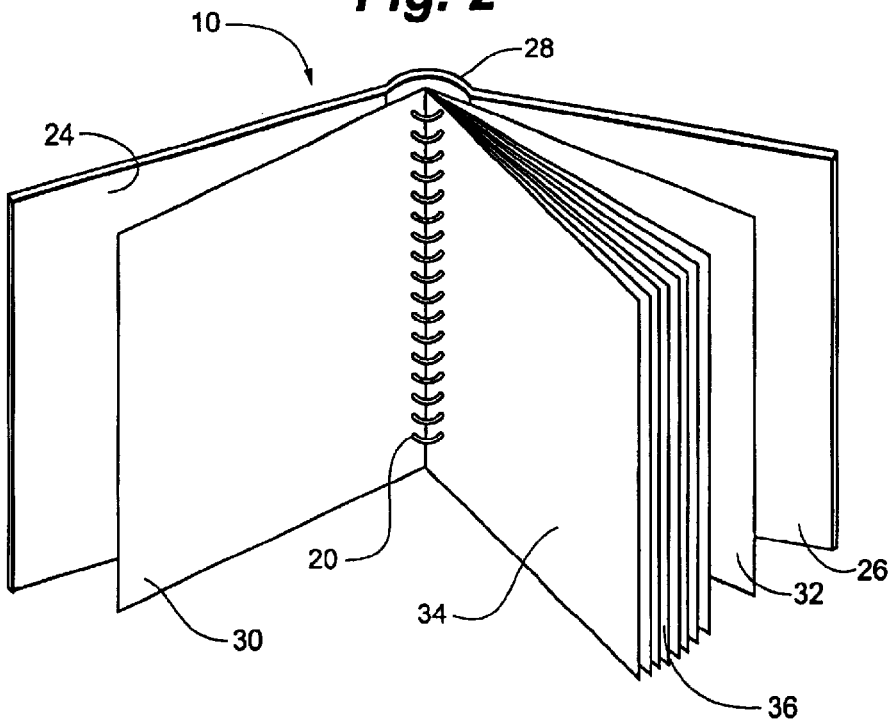
FIG. 2 is an illustration of the plan view of the book opened to expose the front page, main journal and photograph frame pages, and back page.

FIG. 2 is an illustration of one embodiment of the photo journal scrapbook, opened to display the various types of pages contained within. The cover 22 consists of two portions, the front cover 24 and the back cover 26 which are connected by a hinge 28. Adjacent to the front cover 24 and within the photo journal scrapbook 10 is the front page 30. Adjacent to the back cover 26 and within the photo journal scrapbook 10 is the back page 32. Both the front page 30 and the back page 32 may have either a photograph frame side 14 or a journal side 12, which typically faces inwards towards the main pages. The bulk of the pages in a photo journal scrapbook consist of main pages 34, all of which have both a journal side 12 and a photograph frame side 14. The plurality main pages 34 taken as a group constitute the main page section 36.

Figure 3:
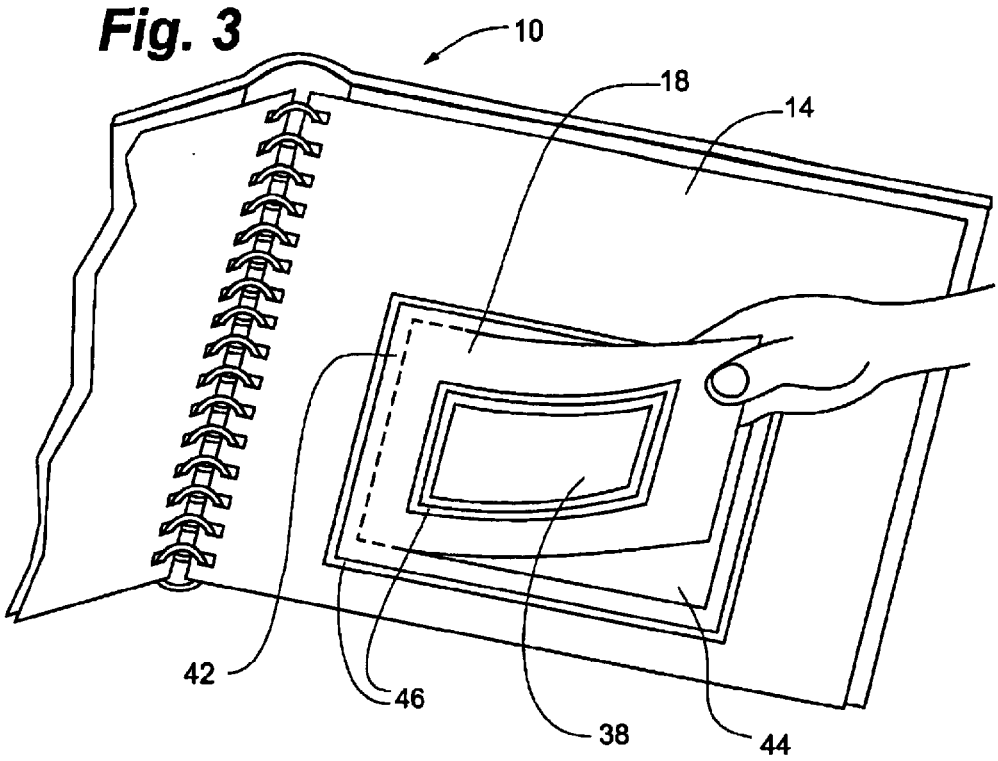
FIG. 3 is a perspective view showing the removal of a potential frame section by hand from a variable size frame on a photograph frame page.

FIG. 3 shows the photograph frame side 14 of a page, and illustrates the manual resizing of a variable size photograph frame 18. The central portion of the variable size photograph frame 14 is the cutout frame portion 38. If a photograph matching this opening is used, the variable size photograph frame 14 does not need to be modified. If, on the other hand, it is desired to include a larger photograph, a potential frame section 40 can be removed. The variable size photograph frame 14 may include one or more potential frame sections 40 arranged concentrically around the cutout frame portion 38. The boundary of the potential frame section is marked by a line of weakened page material 42, which typically comprises perforated page material. However, a crease or depression may also be placed on the page to create the weakened page material 42. When the potential frame section 40 is removed, a larger frame portion 44 is revealed which can accommodate a larger sized photograph. The frame sections can be decorated by an embossed design 46 as shown. Before use, the variable size photograph frames 14 are generally filled with an appropriately sized piece of stiff cardboard or other similar material for aesthetic purposes.

Figure 4:
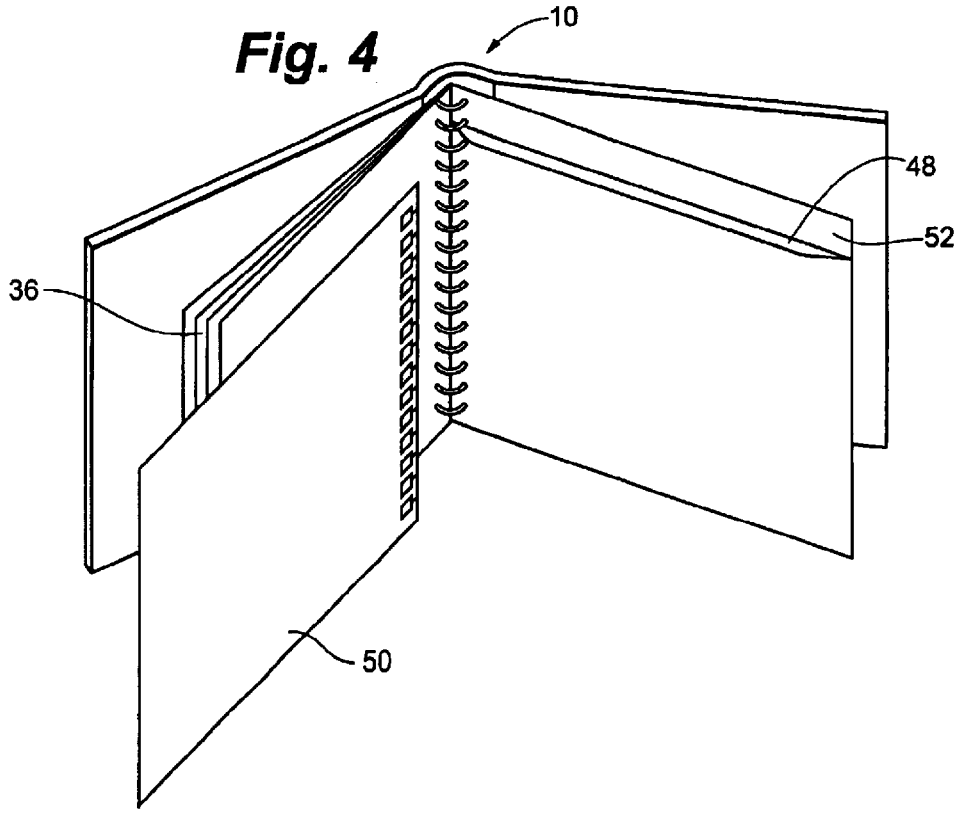
FIG. 4 is a plan view similar to FIG. 2 but showing instead a pocket page and an optional attachable pop-in scrapbook page.

FIG. 4 is an illustration of the photo journal scrapbook 10 opened to display a pocket page 48 and optional pop-in scrapbook page 50 present in additional embodiments. The pocket page 48 is typically placed behind the main pages 36, and has a pocket 52 on each side of the page to allow for the storage of photographs and other memorabilia. The pockets 52 are flush with the pocket pages 48, which are preferably bound into the back of the book behind the main pages, although the pocket pages 48 may be strategically placed throughout the text as well. In a preferred embodiment, pocket pages measure 9"×12" and have a flat pocket 52 on each side of the page capable of storing items up to 8.5"×11" in size. The pocket in this embodiment can store flat material up to ⅛" thick, making the total pocket capacity for the page ¼" of material overall. In an embodiment intended for smaller books, the pocket pages measure 6"×9" with 3" pockets and can store flat material 5"×7" in size, again being able to contain up to ⅛" thick material in each pocket.

FIG. 4 also illustrates an attachable, additional pop-in scrapbook page 50 for use in the photo journal scrapbook. Pop-in scrapbook pages may include punch holes that are slit to the nearest edge to allow them to be snapped into position over the wire binding in each book. Pages of any type may be added to the photo journal scrapbook by this method. In a preferred embodiment, the scrapbook pages are constructed from acid-free black paper and cut to dimensions slightly shorter than the other pages used in the book These pages allow the user to expand the photo journal scrapbook to contain more material than allowed by the initial allotment of pages.

Figure 5:
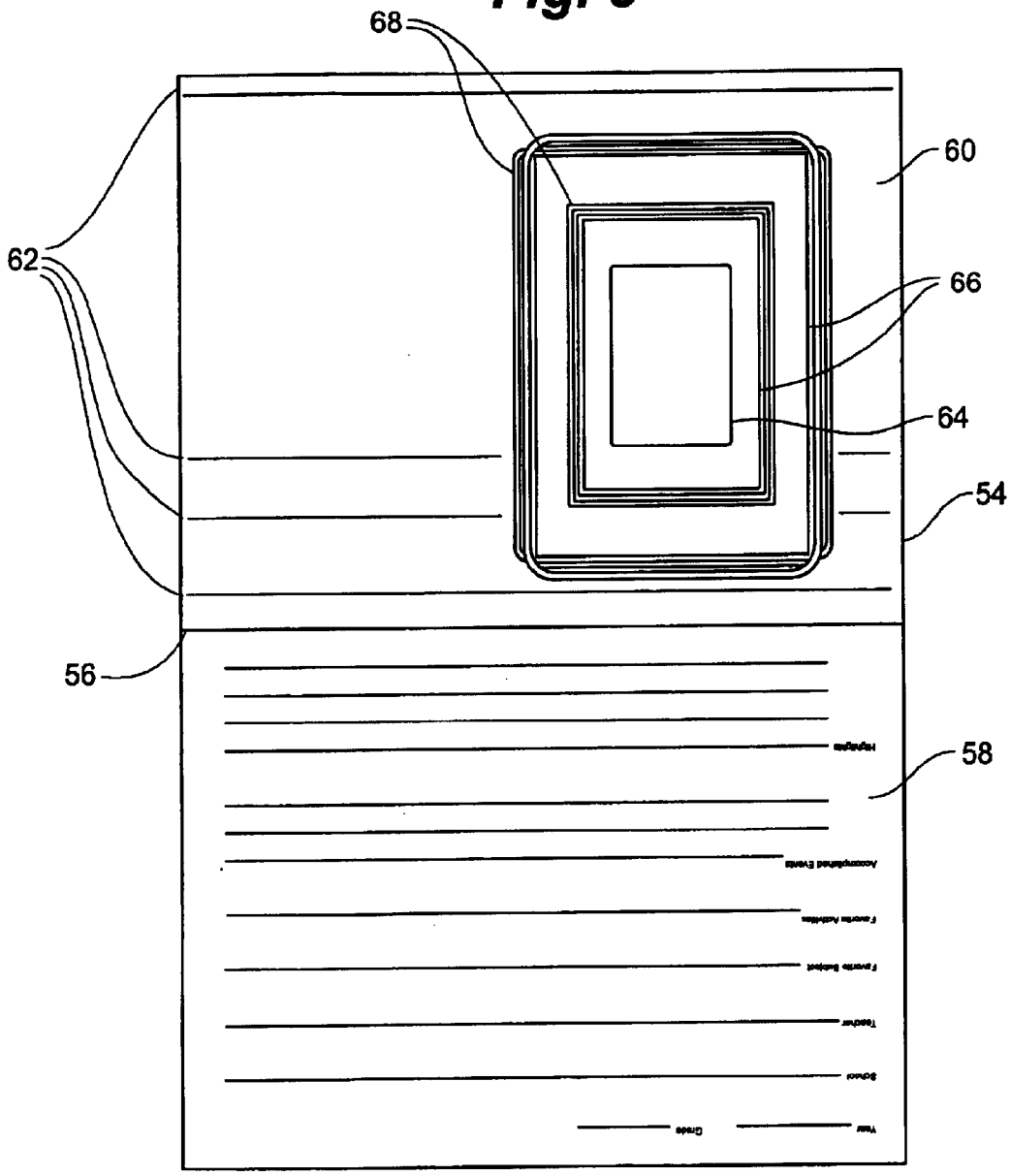
FIG. 5 is a diagram showing the die pattern for a SchooLife™ Academic book.
Figure 6:
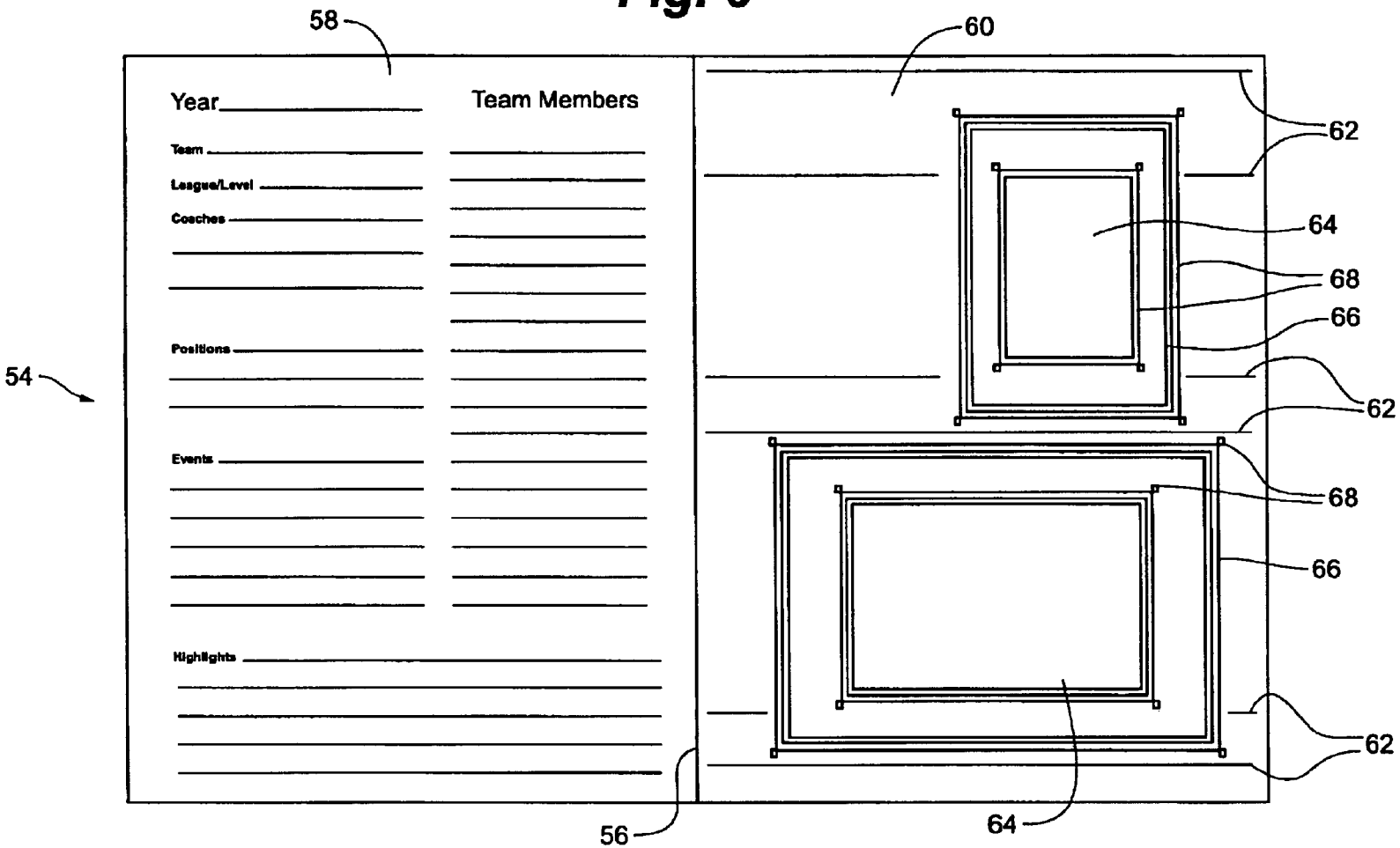
FIG. 6 is a diagram showing the die pattern for a SchooLife™ Activities book.
Figure 7:
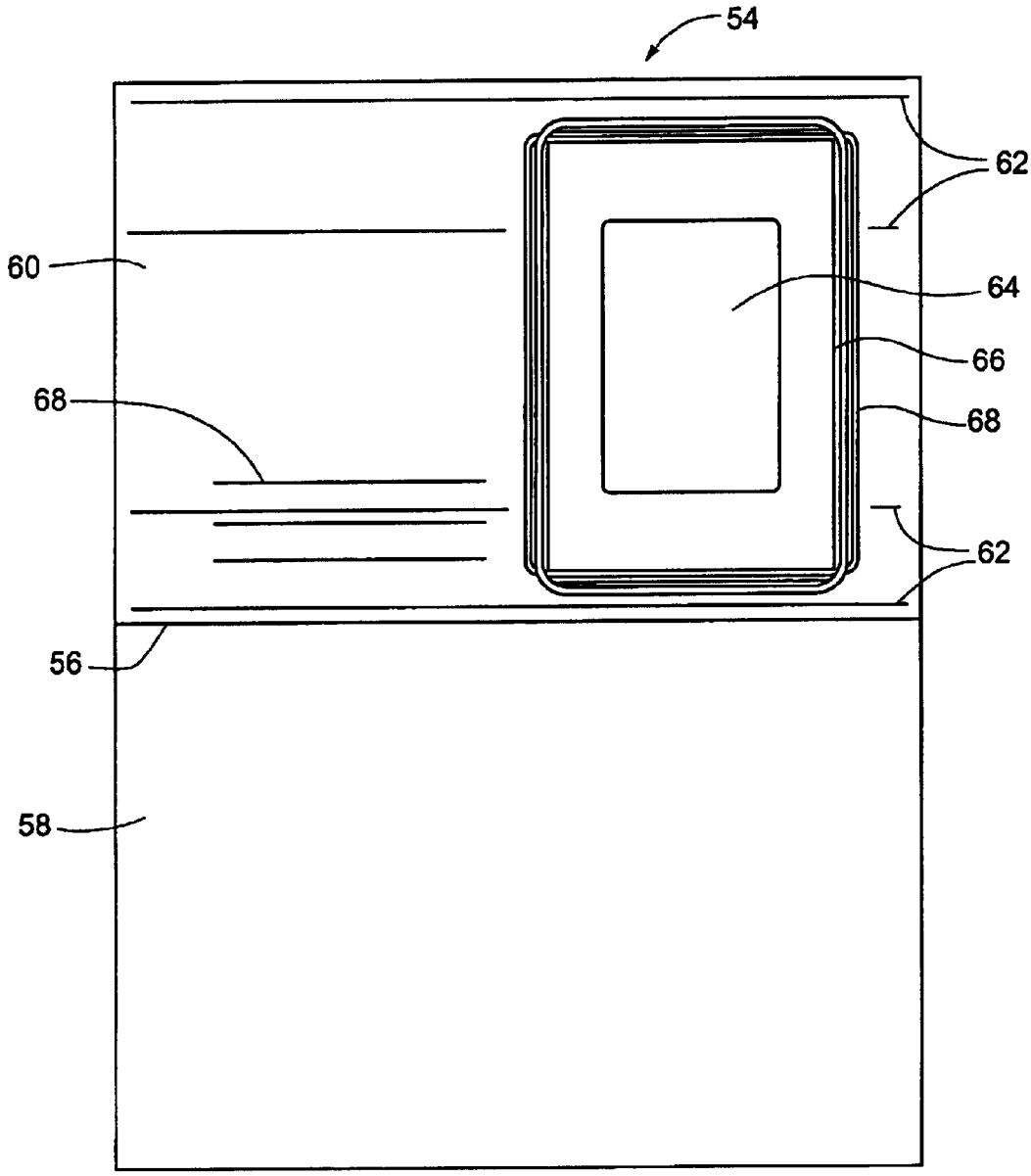
FIG. 7 is a diagram showing the die pattern for a SchooLife™ Friends & Family book.

FIGS. 5–7 illustrate dies 54 that are used to create the main pages for the preferred embodiments referred to as the Academic book, the Activities book, and the Friends and Family book, respectively. The dies are metal score and cut bars used to create the pages used in the books. The dimensions of the pages produced by these dies are given in the detailed Examples provided below. Note that these three dies are exemplary only, and that a wide variety of other dies are contemplated for use in the present invention. Each of the dies 54 has a center. score line 56 at which point the page is eventually folded into two halves; the die journal side 58 and the die frame side 60. Lines representing the positioning of the glue lines 62 which are used to adhere the two sides of the page together are shown. Finally, on the die frame side 60, the cutout pattern 64, the perforation pattern 66, and the embossing pattern 68 are also shown.

The photo journal scrapbook of the present invention is constructed using the following procedure. The first step involves printing the pages which are incorporated into the book. For example, pages for the Activities and Academic book embodiments are constructed from 80 lb Sundance cover weight warm white acid free cotton paper, whereas the Friends & Family pages are constructed from 80 lb Whiting cover weight black felt. The pages are typically manufactured using black soy inks and a satin varnish overcoat. Other printing materials may be utilized while remaining within the scope of the present invention. The main pages used in the photo journal scrapbook have two different sides, one of which serves to record journal entries while the other serves to store photographs. This arrangement should provide a book in which opening to any of the standard pages provides simultaneous access to a journal page for writing notes, as well as a photograph frame page for storing photographs. The pages are printed to accommodate these uses. A title and an end page are generally printed as well; these pages will generally have one side which either enables photograph storage or the writing of journal entries, while the other is used to provide organizational information or simply serve as a spacer page.

After printing, the pages are placed in a die in order to cut the page to the appropriate size and cut out sections such as those used for photographs display. The die also serves to custom emboss and score the page so that it will later fold at the desired points. The die may also serve to perforate or otherwise weaken a concentric array of one or more frames around the sections cut for photograph display in order to provide a variable size frame.

Once the pages have been die cut and stamped, an adhesive or other securing means is applied to portions of one side of the book page so the page can be folded in half to form a page including one or more variable size frames for picture storage on one side, and text and lines to encourage journal entries on the other side. Generally a hot gluing machine is used in this step to place glue strips at specific intervals along the page, but other means of adhering the pages together are suitable for the present invention. Once adhesive has been applied, the pages are folded in half at the center score line so that the page halves are bound together by the adhesive.

Next, the folded book pages are collated in the desired order. Optionally, title and end pages are included at the front and back, respectively, of the collated main pages at this point. The collated pages are then bound together along their inner edge so that one can flip through them as a book. Preferably the edge where the paper was folded earlier is used as the outer edge. While a variety of means exist for binding pages together, it is preferred to bind the pages using industry standard twin loop wire binders. When wire binders are used, the pages must be punched to allow passage of the wire; typically punches are made at 2 per inch scale, although other spacing may be used. The wire or otherwise bound pagination is then cased into wrapped covers, preferably with a library style soft hinged overwrap.

In one embodiment, the photo journal scrapbooks may be cased in with book cloth wrapped hard covers and a library style soft hinge spine overwrap. For example, the Academic book embodiment is wrapped with a durable weave of natural fibers defined as Sail Cloth. Additionally, the Activities book embodiment is wrapped with black chintz-like material. Finally, the Friends and Family book embodiment is wrapped with either Sail cloth, black chintz, or terra cotta colored canvas book cloth. The use of different wraps is primarily an aesthetic consideration, and a variety of wraps can be used for the present invention without impairing the basic functioning of the books.

A preferred embodiment of the photo journal scrapbook includes one or more double sided pocket pages. The double sided pocket pages are constructed from a single sheet of paper, scored and reverse-folded to create external pockets. A facile means of envisioning this aspect of the invention is to picture a standard folder, folded so that it is inside-out. Measurements for each pocket page are detailed in the examples for specific embodiments of the invention described below. Once prepared, the pocket page is bound with the other pages of the photo journal scrapbook, typically though not necessarily near the end of the book. When wire binding is used, the pockets can expand to a greater extent as the sides of the pocket are not attached along the inner side in this embodiment. Generally, the pocket page should be compatible with the page size used for the rest of the book, and large enough to include items such as report cards, large photos, or other keepsakes.

Additional pages may be added to the photo journal scrapbooks. They are preferably created from Strathmore Grandee acid-free black paper and are punched using industry standard twin loop 0.125" square punches at 2 per inch scale. In one embodiment, the punch holes are slit to the nearest edge to allow them to be snapped into position over the wire binding in each book. To insert the extra pages, the punched page "teeth" are laid along the wire spine of the book and each tooth and pressed between, each wire loop. The pages are preferably cut short as a design feature.

As described above, the photo journal scrapbook is very useful for storing photographs and memorabilia. In particular, it provides a single repository for various mnemonic items such as photographs, written notes, and various other keepsakes and memorabilia. Generally, the photographs are stored on the photograph frame sides 14 of the book, while written notes are recorded on the journal sides 12 in the provided prompts. Larger photographs and memorabilia can be stored in pocket pages 48 in embodiments possessing this feature.

Use and construction of the photograph frame sides of the pages will now be described in greater detail in the following examples. In the Academic Book embodiment of the photo journal scrapbook, glue strips are placed in such a way that a 5.25" opening is left at the top of the page above the variable size BreakAway™ frames. This opening allows photographs of a variety of sizes to be slipped through the opening from the top of the book. The frames are perforated in such a way that the one or more different sized potential frame sections can be broken out of the book to accommodate different sized photos. Photo sizes that fit into the Academic Book embodiment are 2"×3" (wallet), 3.5"×5", or 5"×7". Through use of different die cut and gluing patterns, a variety of sizes of photographs can be accommodated. Similarly, the glue strips on the Activities Book embodiment are placed in such a way that a 3.75" opening is left at the top of the page above the vertically positioned variable size BreakAway™ frames and a 5.25" opening is left at the side of the book across from the horizontally positioned variable size BreakAway™ frames. In this embodiment, the vertical frames are perforated in such a way that a different sized window can be broken out of the book to accommodate a variety of photograph sizes, in particular 2"×3" (wallet) or 3.5"×5" photographs. The horizontal frames are perforated in such a way that a different sized window can be broken out of the book to accommodate a variety of photograph sizes, in particular 3.5"×5" or 5"×7" photographs.

The BreakAway™ variable size frames allow the storage of a variety of photograph sizes in a single frame. The photo journal scrapbooks are prepared with a single opening precut in the center of the variable size frames which can be used to hold a photograph of the minimum size allowed by that particular frame. To install a larger photograph, the potential frame section 40 is removed to create the correct opening for the photograph chosen. Fingertips can be slid underneath the potential frame section at the top of precut opening and used to gently push the potential frame section 40 outward. The potential frame section or sections may be broken out down to the glue points at the bottom of the frame. The potential frame section should be carefully bent towards the user, then peeled away from flexible glue points. The bottom edge of frame can then be broken away. It is acceptable if the frame begins to tear slightly at the glue points, as the inserted photograph will cover this and the residual glue will not harm the photo. The photo can then be inserted from the top or side of the book.

Before or after one or more photographs are inserted into their frames, written commentary may be added to the journal side of the page, which is adjacent to where the photographs are being placed. Preferably, a handheld writing device such as a high-quality pen should be used for this; however, any printing device will suffice. The writing may be done contemporaneous with insertion of the photograph to capture the additional ideas evoked by the photograph and prevent the input of commentary from being neglected. Commentary can also include reference to items stored within the pocket section of the book in some embodiments. When items are stored in the pocket pages, commentary may again be provided shortly before or after insertion of these items, for the same reasons given for photographs. One of the advantages of the photo journal scrapbook is that it facilitates the contemporaneous entry of information by providing a single receptacle for various types of mnemonic items.

The invention is further illustrated by the following Examples, in which various embodiments of the photo journal scrapbook are referred to in conjunction with the SchooLife™ trademark.

EXAMPLES

Example #1

The SchooLife™ Academic Book

With 15 photo-journal spreads, this archive carefully preserves childhood school pictures from pre-school through 12th grade. It also includes 2 pocket pages for storing certificates and other keepsakes. It is covered in a durable weave of natural fibers, which are acid free and durable. The SchooLife™ Academic Book is compatible with standard scrapbook materials and pens; is acid-free; uses variable size BreakAway Frames©; contains soft white journal pages; has extra pockets for large photos and certificates; can be provided with additional snap-in pages; and is compatible with standard scrapbook materials. The SchooLife™ Academic Book measures 13.5" wide×9.5" tall×1.5" thick. Each page holds one 2"×3" (wallet), or 3.5"×5", or 5"×7" photo. The pages measure 12" wide by 9" tall and by 0.0625" thick.

The flat size for the SchooLife™ Academic book measures 12.5" wide by 18.5" tall. The upper half of the page, used to store photographs, measures 12" wide by 9" deep and is flood coated with 2 hits of soy-based opaque black ink and one hit of satin varnish, and includes a 0.125" bleed. The bottom half of the page, used as the journal page, also measuring 12" wide by 9", is printed with text appropriate for facilitating and encouraging journal entries. See FIG. 5, which provides a diagram of the page layout.

The pages, along with folding scores, embossed frames, and perforated variable size BreakAway frames, are converted from the printed sheet using a custom designed and manufactured die. The die includes an outer parameter cutting edge with top and bottom sides measuring 12" wide, left and right sides measuring 18" tall. This edge cuts out the flat page at 12" by 18". A scoring bar 12" long is positioned 9" down from and parallel to the top cutting edge. This bar provides a center fold for the finished page. The frame configuration uses a combination emboss and perforation die design as shown in FIG. 5. The outermost embossed edge of the largest frame is positioned 1" down from the top cutting edge, and 1.25" in from the right cutting edge. Each page is then embossed, perforated, and cut from the paper in a single pass.

Pages are then fed through a hot gluing machine where 4 glue heads are used to place glue strips at specific intervals along the page. The first glue strip is placed 0.5" up from the center score, begins 0.125" in from the right cut edge and ends 0.125" in from the left cut edge. The second glue strip is placed 1.75" up from the center score, begins 0.125" in from the right cut edge and consists of a 1" strip followed by a 1" gap, followed by three 0.125" dots at 1" intervals and finishing with a 4.75" strip beginning at 6.5" in from the right cut edge. The third glue strip is placed 2.625" up from the center score, begins 0.125" in from the right cut edge, and consists of a 1" strip followed by a 1.5" gap, followed by two 0.125" dots at 1" intervals and finishing with a 4.75" strip beginning at 6.5" in from the right cut edge. The fourth glue strip is placed 0.1875" down from the top cut edge, begins 1" in from the right cut edge, consists of a 1" strip followed by a 5.5" gap, and finishes with a 4.75" strip beginning 6.5" in from the right cut edge. The 5.5" gap in glue strip #4 provides the top opening through which photos are slipped into the frame.

The page is then folded at the center score to its finished size of 12" wide by 9" tall. Pages are collated into groups of 14. A single title page measuring 12" wide by 9" deep and printed with the SchooLife™ Books title page design on one side, and the SchooLife™ Books journal page of the other side in black ink is collated into the front of each 14 page grouping. A single frame back page with no journal design is printed, converted and collated into the back of each 14 page grouping. This creates a pagination of title page, 15 photo-journal spreads, and ending with a blank white page.

A double sided pocket page is created from a single sheet of 80 lb Sundance warm white cover measuring 24" wide by 14" deep. The sheet is not printed. The sheet is scored horizontally at 9" from the top edge, leaving 5" at the bottom of the page. The sheet is scored vertically at 12" from the right edge, dividing the page in half. The five inch strip of paper below the horizontal score is folded up. The page is then folded in half at the vertical score with the 5" strips facing out. When bound into the book, this strip creates a 5" deep pocket on both the front and back of the page. This pocket configuration is then collated into the back of the 15 photo-journal page grouping. End sheets measuring 12" wide by 9" tall are collated one each into the front and back of each group of pagination.

Pages are punched using industry standard 0.1875" square punches at a 2 per inch scale. The pagination is bound using twin loop wire binders 8.25" long and 1.25" in diameter. The wire-bound pagination is the then cased into book cloth wrapped covers with a library style soft hinged over wrap.

Example #2

The SchooLife™ Activities Book

The SchooLife Activities book includes 13 photojournal spreads to archive commercial school photos from kindergarten through senior high. It is covered in a soft black chintz, is acid free, and includes 2 pocket pages. It measures 10" wide by 12.5" tall and is 1.5" thick. Each page holds one 2"×3" (wallet) or 3.5"×5" photo and one 3.5"×5or 5"×7" photo using variable size BreakAway™ Frames. The pages measure 9" wide by 12" tall by 0.0625" thick.

Flat size for the SchooLife™ Activities page measures 18.5" wide by 12.5" tall. The right half of the page, measuring 9" wide by 12" deep, is flood coated with 2 hits of soy-based opaque black ink and one hit of satin varnish and includes a 0.125" bleed. The left half of the pages, also measuring 9" wide by 12" deep is printed with the SchooLife™ Books journal page. See FIG. 6 which provides a diagram of the page layout.

The pages, along with folding scores, embossed frames, and perforated variable size BreakAway frames, are converted from the printed sheet using a custom designed and manufactured die. The die includes an outer parameter cutting edge with top and bottom sides measuring 18" wide, and left and right sides measuring 12" tall. This edge cuts out the flat page at 18" by 12". A scoring bar 12" long is positioned 9" in from and parallel to the right cutting edge. This bar provides a center fold for the finished page. The frame configuration uses a combination emboss and perforation die design consisting of one horizontal and one vertical framing configuration as shown in FIG. 6. The outermost embossed edge of the largest horizontal frame is positioned 0.75" in from the right cutting edge, and 0.75" up from the bottom cutting edge. The outermost embossed edge of the largest vertical frame is placed 1.325" in from the right cutting edge and 0.75" down from the top cutting edge. Each page is then embossed, perforated and cut from the paper in a single pass.

Pages are then fed through a hot gluing machine where 6 glue heads are used to place glue strips at specific intervals along the page. The first glue strip is placed 0.5" up from the bottom cut edge, begins 0.125" in from the right cut edge and ends 0.125" in from the left cut edge. The second glue strip is placed 2" up from the bottom edge, begins 2" in from the right cut edge, and consists of 4" dots at 1.5" intervals and finishing with a 0.5" strip beginning at 8" from the right cut edge. The third glue strip is placed 6" up from the bottom edge, begins 0.125" in from the right cut edge and ends 0.125" in from the left cut edge. The fourth glue strip is placed 7" up from the bottom edge, begins 0.125" in from the right cut edge, and consists of a 1" strip followed by a 4" gap and finishes with a 3" strip beginning 5.5" in from the right cut edge. The fifth glue strip is places 9" up from the bottom edge, begins 0.125" in from the right cut edge, places a 1" strip followed by a 4 inch gap and finishes with a 3" strip beginning 5.5" in from the right cut edge. The sixth glue strip is placed 0.1875" down from the top cut edge, begins 1" in from the right cut edge, and consists of a 1" strip followed by a 4" gap and finishes with a 3" strip beginning 5.5" in from the right cut edge.

After gluing, the page is then folded at the center vertical score to its finished size of 9" wide by 12" tall. Pages are collated into groups of 12. A single title page measuring 9" wide by 12" deep and printed with the SchooLife™ Books title page design on one side, and the SchooLife™ Books journal page of the other side in black ink is collated into the front of each 12 page grouping. A single frame page with no journal design is printed, converted and collated into the back of each 12 page grouping. This creates a pagination of title page, 13 photo-journal spreads, and ending with a blank white page.

A double sided pocket page is created from a single sheet of 80 lb Sundance warm white cover measuring 18" wide by 16" deep. The sheet is not printed. The sheet is scored horizontally at 12" from the top edge, leaving 4" at the bottom of the page. The sheet is scored vertically at 9" from the right-edge, dividing the page in half. The 4" strip of paper below the horizontal score is folded up. The page is then folded in half at the vertical score with the 4" strips facing out. When bound into the book, this strip creates a 4" deep pocket on both the front and back of the page. This pocket configuration is then collated into the back of the 15 photo-journal page grouping. End sheets measuring 9" wide by 12" tall are collated one each into the front and back of each group of pagination.

The pages are punched for binding using industry standard twin loop square punches at 2 per inch scale. The pagination is bound using twin loop wire binders 11" long and 1.25" in diameter. The wire-bound pagination is the then cased into book cloth wrapped covers with a library style soft hinged over wrap.

Example #3

The SchooLife™ Friends and Family Book

This 6"×9" book preserves individual school or studio photos from year to year. 19 spreads let you keep wallet or 3.5"×5" photos from birth through 18 years. It includes 2 pocket pages for additional keepsakes. It is available in black chintz, terra cotta canvas, or oatmeal weave with black pages, is acid-free, and is well suited for use by relatives, friends, or coaches. The SchooLife™ Family and Friends Book measures 10.25" wide×6.5" tall×1.5" thick. Each page holds one 2"×3" (wallet), or 3.5"×5" photo using variable size BreakAway™ frames. The pages measure 9" wide by 6" tall by 0.0625" thick.

Flat size for the SchooLife™ Friends and Family page measures 9.5" wide by 12.5" tall. The pages, along with folding scores, embossed frames, and perforated variable sized BreakAway™ frames, are converted from the printed sheet using a custom designed and manufactured die. The die includes an outer parameter cutting edge with top and bottom sides measuring 9" wide, left and right sides measuring 12" tall. This edge cuts out the flat page at 9" by 12". A scoring bar 9" long is positioned 6" up from and parallel to the bottom cutting edge. This bar provides a center fold for the finished page. The frame configuration uses a combination emboss and perforation die design consisting of one vertical framing configuration as shown in FIG. 7. The outermost embossed edge of the largest horizontal frame is positioned 0.75" in from the right cutting edge, and 0.325" up from the horizontal score. Each page is then embossed, perforated, and cut from the paper in a single pass.

The pages are then fed through a hot gluing machine where 4 glue heads are used to place glue strips at specific intervals along the page. The first glue strip is placed 0.25" up from the center score, begins 0.125" in from the right cut edge and pattern ends 0.125" in from the left cut edge. The second glue strip is placed 1" up from the bottom edge, begins 0.125" in from the right cut edge, and consists of a 0.5" strip followed by a 1" gap glue followed by 3" dots at 0.5" intervals, followed by another 1" center score 6" from top gap and finishing with a 3.75" strip beginning at 5" from the right cut edge. The third glue strip is placed 4.5" up from the bottom edge, begins 0.125" in from the right cut edge, and consists of a 0.5" strip followed by 4" gap, and finishing with a 3.75" strip beginning at 5" from the right cut edge. The fourth glue strip is placed 0.1875" down from the top cut edge, begins 0.125" in from the right cut edge, places a 0.5" strip followed by a 4" gap and finishes with a 3" strip beginning 5.5" in from the right cut edge. After gluing, the page is then folded at the center horizontal score to its finished size of 9" wide by 6" tall. Pages are collated into groups of 19.

A double sided pocket page is created from a single sheet of 80 lb Whiting cover weight black felt measuring 9" wide by 9" deep. The sheet is not printed. The sheet is scored horizontally at 6" from the top edge, leaving 3" at the bottom of the page. The sheet is scored vertically at 9" from the right edge, dividing the page in half. The 3" strip of paper below the horizontal score is folded up. The page is then folded in half at the vertical score with the 3" strip facing out. When bound into the book, this strip creates a 3" deep pocket on both the front and back of the page. This pocket configuration is then collated into the back of the 19 photo page grouping. End sheets measuring 9" wide by 6" tall are collated one each into the front and back of each pagination.

The pages are punched using industry standard twin loop square punches at 2 per inch scale. The pagination is bound using twin loop wire binders 5" long and 1.25" in diameter. The wire-bound pagination is the then cased into book cloth wrapped covers with a library style soft hinged over wrap.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A photo journal scrapbook comprising:

front and back covers;

a plurality of main pages retained between said front and back covers, wherein said main pages include a photograph frame side bearing one or more frames to retain photographs, said frames comprising a concentric series of variably sized frame sections, wherein the frame sections include boundaries of marked and weakened page material, and a journal side with printing organized to receive writing; and a binder which secures said front and back covers to said plurality of main pages.

2. The photo journal scrapbook of claim 1, wherein the page material is weakened by perforation.

3. The photo journal scrapbook of claim 1 wherein the front and back covers comprise hard covers wrapped with a cloth selected from the group consisting of soft chintz, sail cloth, and terra cotta canvas.

4. The photo journal scrapbook of claim 1 further comprising one or more pocket pages retained by the binding.

5. The photo journal scrapbook of claim 1 further comprising one or more scrapbook pages retained by the binding.

6. A photo journal scrapbook comprising:

front and back covers;

a plurality of main pages retained between said front and back covers, wherein said main pages include a photograph frame side bearing one or more frames to retain photographs and a journal side with printing organized to receive writing; and a binder which secures said front and back covers to said plurality of main pages; wherein said main pages comprise a sheet of paper folded in the center to form two equal portions which are overlaid and connected with an adhesive.

7. The photo journal scrapbook of claim 6 wherein said binding retains the front and back covers and pages in a fashion that enables their movement through an arc of at least 180° to allow opposing pages in said photo journal scrapbook to lie flat when said book is supported on a surface.

8. The photo journal scrapbook of claim 7 wherein said binding comprises twin loop wire binding.

9. The photo journal scrapbook of claim 8 wherein said binding is covered with a library style soft hinge spine overwrap.

10. The photo journal scrapbook of claim 6 wherein said adhesive is deposited in a pattern which reinforces the photograph frames.

11. The photo journal scrapbook of claim 10 wherein said photograph frame side is coated with a lower layer of ink and an upper layer of varnish.

12. A method of making a photo journal scrapbook comprising the steps of:

printing upon a plurality of book pages of a chosen size a background and markings to create photograph frame pages and journal pages on opposing sides of said book pages;

cutting and indenting the plurality of book pages using a custom designed die to create a page shape, frame openings, score lines, and perforations;

administering adhesive to portions of one side of the book page;

folding the book page in half at a center score line so that the page halves are bound together by said adhesive;

collating a plurality of the folded book pages;

binding the folded book pages together; and inserting and attaching the bound folded book pages into a wrapped cover.

13. The method of claim 12 further including the step of collating a title page into the front of the collated folded book pages subsequent to collating the plurality of folded book pages.

14. The method of claim 12 further including the step of collating a back page into the back of the collated folded book pages subsequent to collating the plurality of folded book pages.

15. The method of claim 12 further including the steps of:

scoring and folding a sheet of paper or cardboard to create a double sided pocket page; and binding one or more of said double sided pocket pages into the photo journal scrapbook.

16. The method of claim 12 wherein a twin loop wire is used to bind the collated folded book pages together, and further including the step of punching holes near one edge of the folded book pages to enable binding with said twin loop wire.

17. The method of claim 12 comprising the additional step of manually attaching supplementary pop-in scrapbook pages to the binding of said photo journal scrapbook.

18. A method of using a photo journal scrapbook comprising the steps of:

opening a photo journal scrapbook;

sliding fingertips underneath the cutout frame opening of a variable size frame;

gently pushing a potential frame section outward until it breaks at the provided weakpoint adjacent to a glue point;

tearing away the remainder of the potential frame section along the weakpoint lines;

sliding in a photograph into a frame on a photograph frame page; and creating written commentary related to said photograph on an adjacent journal page.

19. The method of claim 18 further including the step of adding additional pop-in scrapbook pages.

20. A variable size frame for use in a photo journal scrapbook, comprising:

a lower portion comprising a sheet of backing material;

an upper portion comprising a sheet interrupted by one or more cutout frame openings, wherein each cutout frame opening forms the a center of one or more concentric potential frame sections delineated by perforated lines that can be torn by hand to create a larger frame opening; and a pattern of glue lines which adhere the lower portion to the upper portion and further define potential frame sections.

* * * * *